US007298673B2

(12) United States Patent
Pappas et al.

(10) Patent No.: US 7,298,673 B2
(45) Date of Patent: Nov. 20, 2007

(54) TIME ATTENDANCE CLOCK AND SYSTEM

(75) Inventors: Anthony Henryk Pappas, Woodland Hills, CA (US); Scott K. Prewett, Woodland Hills, CA (US); John L. Milligan, Camarillo, CA (US); Stuart A. Karten, Venice, CA (US); Valerie L. Doran, Woodland Hills, CA (US)

(73) Assignee: Exaktime Innovations, Inc., Woodland Hills, CA (US)

( * ) Notice: Subject to any disclaimer, the term of this patent is extended or adjusted under 35 U.S.C. 154(b) by 0 days.

(21) Appl. No.: 11/306,278

(22) Filed: Dec. 21, 2005

(65) Prior Publication Data

US 2006/0146649 A1 Jul. 6, 2006

(51) Int. Cl.
*G04B 47/00* (2006.01)

(52) U.S. Cl. ..... 368/10; 235/377; 346/20

(58) Field of Classification Search ..... 368/10; D10/15; 235/377; 346/20
See application file for complete search history.

(56) References Cited

U.S. PATENT DOCUMENTS

| | | | | |
|---|---|---|---|---|
| 4,368,989 | A * | 1/1983 | Kawashima | 368/74 |
| 5,790,040 | A * | 8/1998 | Kreier et al. | 340/693.1 |
| 6,021,712 | A * | 2/2000 | Harrop | 100/43 |
| 6,456,569 | B1 * | 9/2002 | Stauffer | 368/236 |
| 6,564,600 | B1 | 5/2003 | Davis | |
| 7,103,392 | B2 * | 9/2006 | Fletcher et al. | 455/569.1 |
| 2003/0103413 | A1 * | 6/2003 | Jacobi et al. | 368/10 |
| 2003/0174586 | A1 * | 9/2003 | Hon et al. | 368/84 |
| 2004/0146174 | A1 * | 7/2004 | Iwasa et al. | 381/396 |
| 2006/0227982 | A1 * | 10/2006 | Miranda | 381/151 |

OTHER PUBLICATIONS

Specs: exaktime.com/specs.htm; Dec. 24, 2002.*
Faq: exaktime.com/FAQ.htm; Dec. 2, 2003.*
Lockbox: exaktime.com/lockbox.htm; Jun. 22, 2003.*
Job Clock Six Steps: exaktime.com/6Step.html; Jan. 18, 2002.*
Sample Job Site Report: exaktime.com/Report4.html; Jan. 18, 2002.*
Sample Attendance Report; exaktime.com/Report1.html; Jan. 18, 2002.*
The Jobclock: exaktime.com/jobclock.htm; Dec. 2, 2003.*

* cited by examiner

*Primary Examiner*—Vit Miska
*Assistant Examiner*—Sean Kayes
(74) *Attorney, Agent, or Firm*—Kelly Lowry & Kelley, LLP

(57) ABSTRACT

A time attendance system, including a time attendance clock, designed to be used in harsh conditions, such as outdoor job sites. A portable touch button, including a passively readable code, is brought into contact with the time attendance clock so as to create a time attendance record stored in the clock. Visual indicators and audible notification alert the employee of the acceptance of the act. Periodically, the time attendance records are retrieved from the time attendance clock, such as by using a hand-held electronic device which communicates in a wireless manner with the time attendance clock.

1 Claim, 5 Drawing Sheets

TIME ATTENDANCE CLOCK AND SYSTEM

BACKGROUND OF THE INVENTION

The present invention generally relates to clocks and time keeping apparatuses. More particularly, the present invention relates to a time keeping apparatus specifically designed for monitoring employee time, such as at a job construction site or the like.

It is common practice for employees to "clock-in" and "clock-out" when checking in and checking out of work, such as when arriving at work, taking a lunch break and leaving for the day. The use of time clocks for tracking the time when an employee checks in and checks out is common place.

However, an employee or supervisor must collect the time cards at the end of the shift or work period (usually every week or two) and calculate the hours worked each day for each employee. This is a time consuming and expensive task. Moreover, in some work environments, such as a construction job site, it is difficult to monitor when employees check in and check out. This is due to the fact that such work sites are often outdoors and not conducive to the traditional time clock apparatuses. A company can lose thousands of dollars per year when employees arrive fifteen minutes late and leave fifteen minutes early, but do not reflect it on the written timesheets.

Applicant, ExakTime, Inc., currently offers a time attendance clock which is particularly suited for outdoor use, such as at job construction sites and the like, and which overcomes the aforementioned drawbacks. The time clock apparatus is sold under the Jobclock™ name, and was modeled after an electronic lock disclosed in U.S. Pat. No. 6,564,600. The Jobclock™ includes a touch button detector, which detects touch buttons owned by each employee. When the touch button is brought into contact with the clock, the identity of the employee and the time is saved in an electronic record. Checking in and checking out can be tracked over time. A hand-held device, such as a Palm Pilot or the like, can be used to retrieve the data. The data is then processed through a software program to generate a report of the employee's time over the work period.

While overcoming the many disadvantages of the manual time tracking procedures, and being much more durable then traditional time clock apparatuses, the Jobclock™ also presents several drawbacks. Proprietary software protocol is used for tracking the time of each employee and for interfacing with the hand-held device. This has created incompatibility issues, which have increased over time.

Another drawback of the Jobclock™ apparatus is that the battery tends to fall out from the electrical contact periodically, and particularly in hotter weather, rendering the clock useless. Due to the design and configuration of the Jobclock™, it is very difficult to disassemble and then reassemble the clock in order to change or reinsert the battery. This is due to the need to disassemble several back plates, untwist the back plates from one another in one direction, and then during reassembly, fit the pieces together, properly align them, and twist them in the opposite direction. Those not familiar with the assembly of the Jobclock™ find it very difficult to disassemble and reassemble the apparatus. Due to the tendency for the battery to fall out from the electrical contact and the fact that the battery life is limited to no more than approximately four or five months, disassembly and reassembly must be undertaken periodically.

The Jobclock™ also includes an opening which serves as an audio outlet for a single tone buzzer to audibly indicate that a key has been detected and read. However, this opening permits water to enter into the clock which can create electrical shorts and operational problems.

When placing a touch button into contact with the clock, a single red light emitting diode visually indicates when the key is detected and read. However, this visual indicator is not visible when the key is brought to the detector area as it is immediately adjacent to the contact area. If the single audible tone is not heard, such as when placed against a wall or other flat surface, or otherwise not operational, there is confusion as to whether one has clocked in or out.

Another drawback of the Jobclock™ apparatus is that it only has the capacity of approximately 3500 time records. Due to the proprietary communication protocol and software, the download speed is relatively slow. Moreover, when the records are downloaded, they are not retrievable by the user from the Jobclock™ memory. If, for whatever reason, the time records are lost before being processed, they cannot be easily retrieved.

Accordingly, there is a continuing need for a time clock apparatus which automates the time keeping procedure, while being specifically designed for outdoor use, such as at job construction sites and the like, while overcoming the drawbacks of the existing time keeping apparatuses. The present invention fulfills these needs and provides other related advantages.

SUMMARY OF THE INVENTION

The present invention relates to a time attendance clock, and related time attendance system, which overcomes the disadvantages described above. The time attendance system of the present invention utilizes portable touch buttons which include a passively readable code unique to the holder of the touch button. The touch button is brought into contact with the time attendance clock, which reads the touch button and creates a time attendance record, including the readable code and time of contact. Means for communicating with the time attendance clock is provided, such as a hand-held electronic device having an infrared signal protocol to communicate with the transceiver of the time clock so as to extract time records therefrom. The communicating means may also comprise an electronic cable port, such as a serial or USB port, built into the time attendance clock.

The time attendance clock used in accordance with the present invention includes a housing sealed against water intrusion. The housing includes a front housing member and a back housing member, with a gasket disposed between them to provide a water tight seal therebetween.

A touch button contact extends through the front housing member so as not to be in electrical contact therewith. An electronic circuit disposed within the housing is electrically connected to the touch button contact so as to receive signals therefrom as the touch button interfaces with the touch button contact, typically by bringing the touch button into physical contact with the touch button contact detector. The electronic circuit includes a real time clock, a processor and memory adapted to store a time attendance record comprising the touch button code received from the touch button contact, and a time of touch button interface.

A plurality of visual indicators, such as differently colored light emitting diodes, are operably connected to the electronic circuit. The visual indicators are spaced from the touch button contact so as to be viewable through the front housing member as the touch button is moved into proximity to the touch button contact. Typically, the light emitting diodes are disposed in a lens assembly abutting a window formed in the front housing member. A transceiver is disposed adjacent to the visual indicators and adapted to receive and transmit IRDA signals. Using the transceiver, the hand-held device can extract stored time attendance records from the clock, and otherwise interact with the clock as needed, such as resetting the clock to avoid drift.

In a particularly preferred embodiment, a multi-tone speaker is operably connected to the electronic circuit and adapted to emit an audible notification upon occurrence of predetermined events, such as clocking in and out, extracting records, etc. The back housing member preferably includes a plurality of apertures generally aligned with the speaker to facilitate the transmission of the audible notification from the speaker. Typically, the back housing member also includes projections on a rear face thereof to permit the audible notification to be heard when the time clock is placed against a flat surface. An air permeable, but liquid impermeable, membrane is disposed over the apertures of the back housing member to prevent water from entering the housing.

The time attendance clock is typically battery powered, and includes a battery tray disposed in the housing adjacent to the electronic circuit. A battery receptacle accepts the replaceable battery, and includes battery orientation symbols. The battery receptacle also includes at least one spring loaded prong adapted to securely hold the battery in the receptacle.

A housing guard is removably attached to the front housing member. Typically, the housing guard includes plurality of prongs adapted to be snap-fit over depressions in the front housing member.

Typically, the housing includes a projection having an aperture for hanging the time attendance clock from an object, such as pad lock or the like. The projection comprises at least one plate disposed between the front and back housing members, and defining the projection extending upwardly from the housing. In a particularly preferred embodiment, a first plate is attached to the back housing member, and a second plate to the front housing member. The first and second plates have alignable apertures when the front and back housing members are attached to one another.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF PREFERRED EMBODIMENTS

As shown in the accompanying drawings, for purposes of illustration, the present invention resides in a time attendance system, including a time attendance clock which is capable of being used in harsh environments, such as outdoor construction sites, for monitoring time and attendance as necessary. As will be more fully described herein, the time attendance clock, generally referred to by the reference number 10, is a self-contained, battery-powered and weather hardened time keeper apparatus which tracks employee activity with respect to clocking in and out during a given time period.

Figure 1:
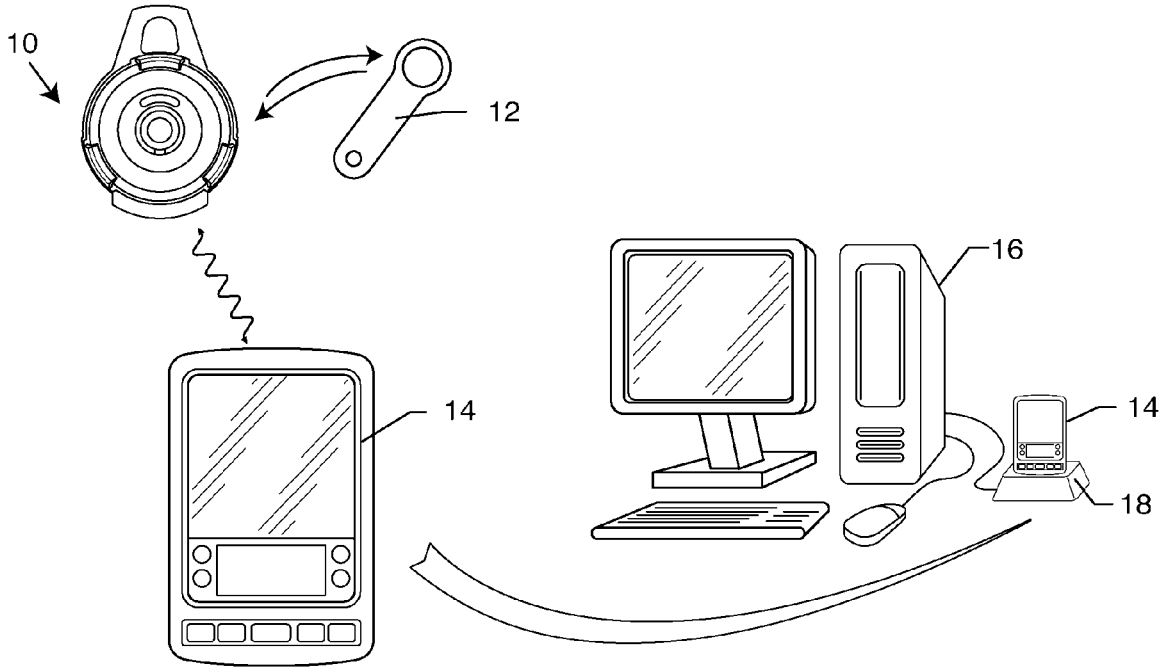
FIG. 1 is a block diagram of a timekeeping system embodying the present invention, and including a time attendance clock used in accordance with the present invention.

With reference now to FIG. 1, the overall system of the present invention is illustrated. It generally comprises four elements. A time attendance clock 10 is activated by a touch button 12, having an element on an end thereof capable of being read and transmitting a code representing the identity of the touch button 12 so that the time for that particular employee can be monitored as the touch button is brought into contact with the time attendance clock 10. As will be more fully described herein, the time attendance clock 10 is a self-powered and portable unit which includes the necessary electronics for reading and recognizing the identity of the touch buttons, and creating a log or time attendance record of each time that a touch button is read, while associating a time with that occurrence.

Periodically, such as every week or two, the time attendance records are downloaded from the time attendance clock. In a particularly preferred embodiment, this occurs in a wireless manner by use of a hand-held electronic device 14, such as a personal digital assistant, Palm Pilot™ and the like. The communications protocol utilized by the time attendance clock 10 and the hand-held device 14 is by means of IrDA, which is the industry standard. In this manner, the time attendance clock 10 can communicate with a wide variety of hand-held devices using the industry standard communications protocol. Communication between the hand-held device 14 and the time attendance clock 10 can also serve other purposes, such as resetting the internal clock of the time attendance clock 10, so as to synchronize the clock and avoid drift, which can create inaccurate time records over time.

The hand-held device is then interfaced with a computer 16, such as a laptop or desktop computer. This may occur by means of a docketing station 18, or tables, in a wireless manner, etc. The time attendance records are then downloaded into a software program stored on the computer 16 for analysis and the creation of time attendance timesheets for each employee over the period of time. The time attendance records can be edited, printed, etc., at the computer 16 as necessary. The software on the computer 16 also enables the employer to track labor costs, insert job codes for billings at different rates, prepare a payroll for the company's employees, etc.

Although the time attendance clock 10 itself can be interfaced with the computer 16, using cables or the like, typically, however, the hand-held device is used to extract the information while the time attendance clock 10 is left in its location, such as at a remote job site.

Figure 3:
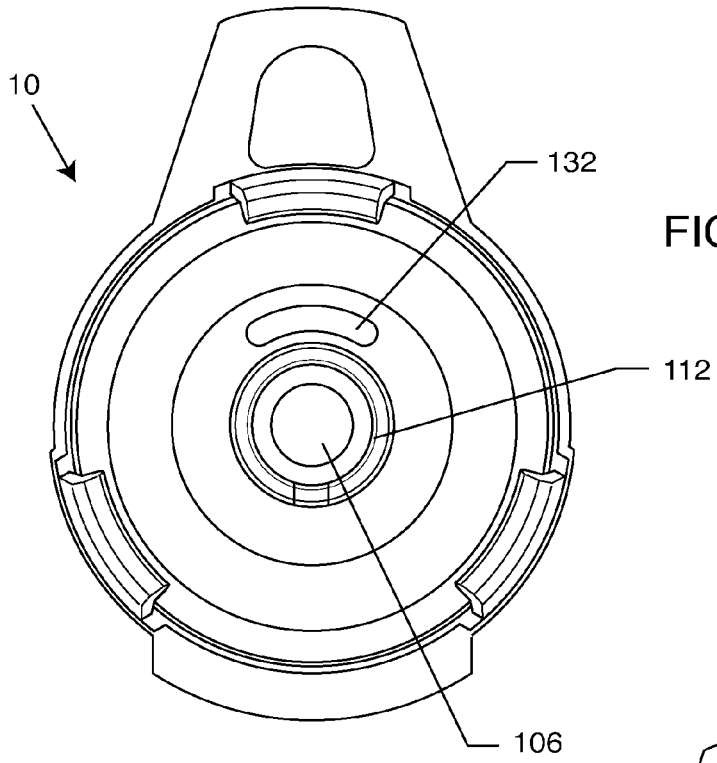
FIG. 3 is a front view of the time attendance clock embodying the present invention.
Figure 4:
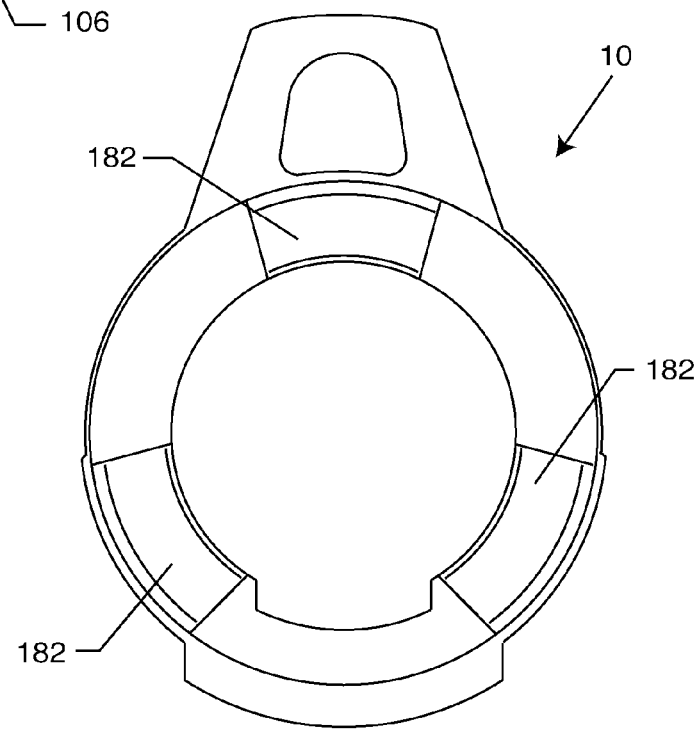
FIG. 4 is a rear view of the time attendance clock of the present invention.
Figure 5:
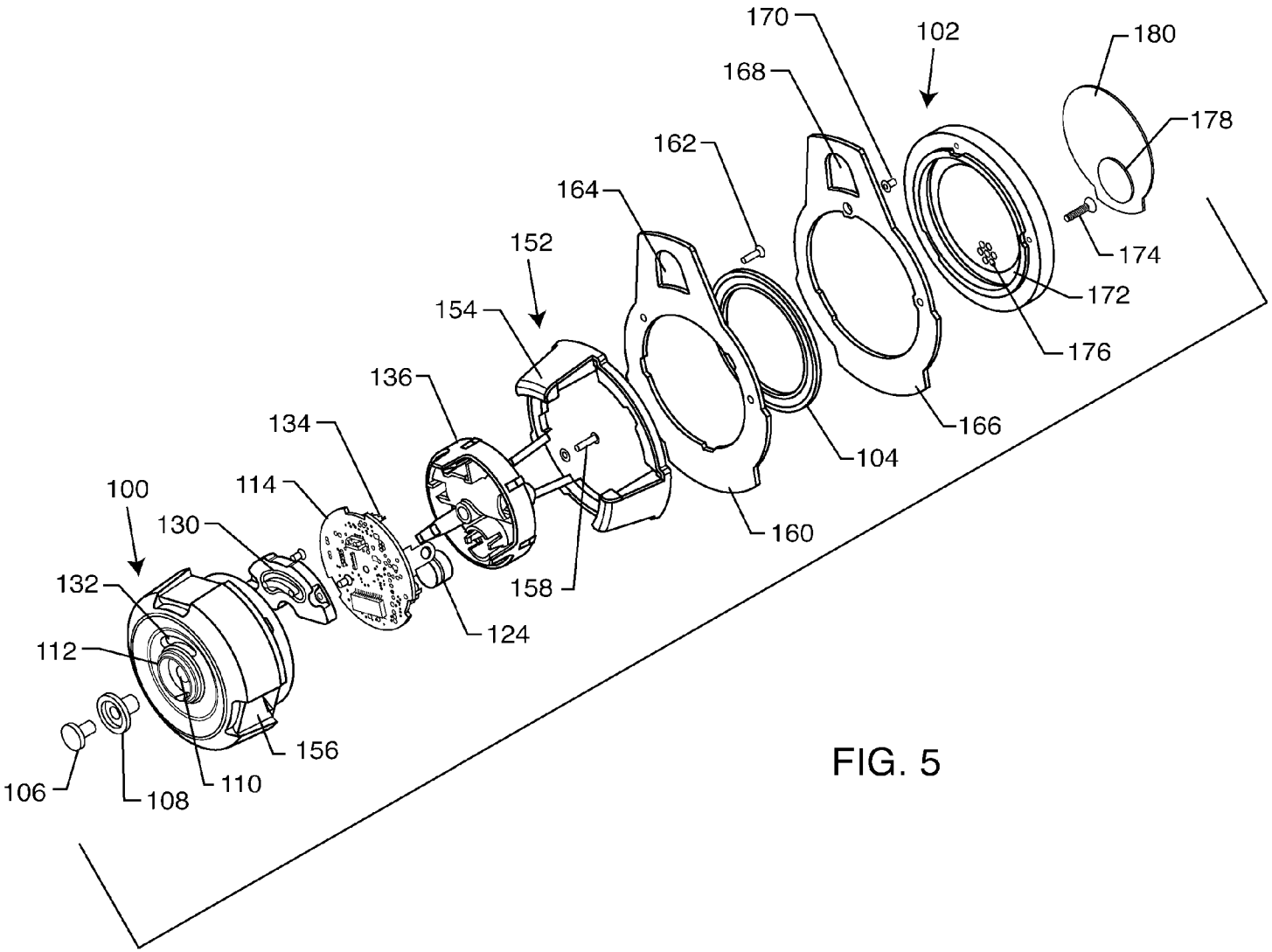
FIG. 5 is an exploded perspective view of a time clock apparatus used in the system of the present invention, illustrating the various component parts thereof.

With reference now to FIGS. 3-5, the time clock apparatus 10 is shown from front and back views, as well as an exploded perspective view to show the various component parts thereof. In a particularly preferred embodiment, the clock 10 is manufactured so as to be very durable. The clock 10 is designed so as to withstand temperature extremes in the range of −10° F. to 150° F. As will be more fully described herein, the clock 10 is also designed so as to be waterproof.

With reference now to FIG. 5, the clock 10 includes a front housing member 100 and a back housing member 102 which are attachable to one another so as to cooperatively form a housing or case. The housing members 100 and 102 are preferably comprised of electroless nickel plated aluminum, or other such durable material. A gasket 104 is disposed between the front and back housing members 100 and 102 so as to create a waterproof seal therebetween to prevent incursion of water into the housing which can harm delicate electronics.

A metallic touch button contact or detector 106 extends through the front housing member 100, typically through a mating front insulator 108, such that the detector 106 is kept in electrical isolation relative to the front housing member 100. Preferably, both the touch button detector 106 and insulator member 108 include adhesive or other sealant so as to prevent water from entering the clock 10 through the front housing member 100. The front housing member 100 includes a recess and aperture 110 for receiving the insulator 108 and touch button contact detector 106, such that they are flush or reside within a depression therein. Preferably, this depression is encircled about by a lip 112, which serves as a guide to the employees when bringing their touch buttons 12 into contact with the detector 106.

A printed circuit board 114 with the necessary electronic components, such as a microcontroller or microprocessor, memory, etc., resides within the clock 10 and is electronically connected to the touch button contact detector 106, so as to receive and interpret codes from the touch buttons coming into contact therewith.

Figure 2:
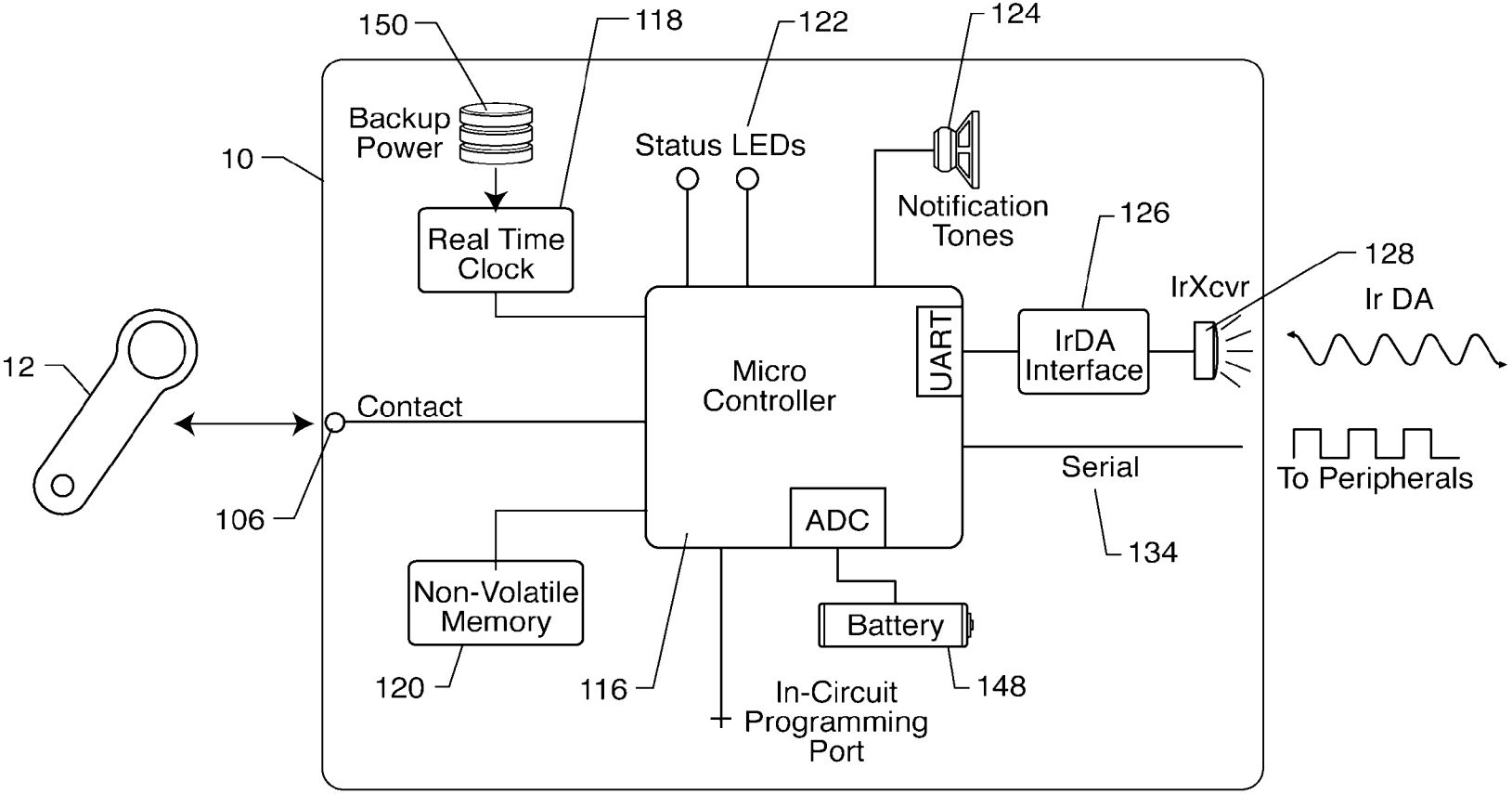
FIG. 2 is a block diagram depicting a touch button and internal component of the time clock, in accordance with the present invention.

With reference now to FIG. 2, an exemplary electronic logic diagram is shown. When an employee's touch button 12 is brought into contact with the touch button contact or detector 106, the integrated circuit housed within a stainless steel container of the touch button 12 (illustrated as the circular end portion thereof), the code is read and relayed to the microcontroller. The touch button contact or detector 106 can be any device which can read a touch button 12 and send a signal corresponding to the touch button 12 to the microcontroller or microprocessor 116. In a particularly preferred embodiment, the contact detector 106 uses a touch button system sold under the trade name Touch Memory Button by Dallas Semiconductor of Dallas, Tex. The system operates by providing a touch button 12 which contains an integrated circuit housed within a stainless steel container. The system is passive, in that the touch button 12 has no power source. The detector 106, in response to being touched by the stainless steel container of the touch button 12 sends a signal to read the code of the touch button 12 encoded in the integrated circuit thereof. Every touch button 12 code is unique. After reading the code of the touch button 12, the detector 106 sends a signal to the microcontroller 116 corresponding to the code of the touch button 12.

Each time a touch button 12 is brought into contact with the touch button contact detectors 06, its unique code is relayed to the microcontroller 116 for storage. At this time, the time of this occurrence is obtained from a real time clock in the electronic circuit which is in electronic communication with the microcontroller 116. The received and interpreted code as well as the extracted time is saved in a memory 120 as a time attendance record.

Visual indicators such as light emitting diodes 122 are powered so as to visually notify the employee that the touch button has been properly brought into contact with the detector 106 and that the employee has clocked in or out. The clock 10 preferably includes a plurality of visual indicators, in the form of red and green light emitting diodes. In a particularly preferred embodiment, an audible notification is also given by a multi-tone speaker 124. The multi-tone speaker 124 is capable to emitting a range of notification tones. These tones are distinct in sound so as to be unique and easily understood. In this manner, the employee can quickly determine if the touch button 12 has not been completely brought into contact with the detector 106, as the red LED instead of the green LED will be lit and a different audible notification will be heard. The LED 122 and speaker 124 can also be used to notify of other conditions. The following table describes the LED and audio under different conditions (configurable items are indicated with the $x_t$):

| Event | Visual Indicator | Audio Indicator |
|---|---|---|
| Successful Read | Rapid Green Flash for 1 second $x_t$ | Success Tone $x_t$ |
| Stutter Touch | None | None |
| Short Circuit (any metal bridged or incomplete iButton read) | Rapid Flash for 100 ms | Short Circuit Tone |
| Download Data In Progress | Rapid Alternating Red/Green $x_t$ | Clicking Type Tones During Download $x_t$ |
| Download Data Successful | Solid Green LED for duration of Tone | Download Success Tone $x_t$ |
| Download Data Interrupted | Solid Red LED for duration of Tone $x_t$ | Download Fail Tone $x_t$ |
| Low Battery | Alternating Red/Green Flash every 2 seconds $x_t$ | None |
| Sleep | Two Rapid Red/Green Blinks, 3 seconds off | None |
| Idle | Green Flash every 2 seconds $x_t$ | None |
| Start-Up | One second Red/Green On | One second tone |
| Clock Reset | Alternating Red/Green Every 500 ms | None |
| Error Condition | Alternating Red/Green Every 500 ms | None |

The time attendance clock 10 interfaces with the external world via not only the touch button electronic contacts, but also with infrared and peripheral serial interface ports. The electronic circuitry includes an IrDA interface 126 which is in electronic communication with an infrared transceiver 128 for receiving and transmitting infrared signals. In the clock 10 of the present application, these infrared signals are non-proprietary and conforming to the industry standard so as to enable the communication of the clock 10 with a wide variety of existing hand-held devices. The protocol is open and releasable, instead of being proprietary, so as to further facilitate communication. When the time attendance records need to be retrieved, as described above, the hand-held device wirelessly communicates with the transceiver 128 to extract a copy of the time attendance records from the memory 120. The clock 10 of the present invention can store at least 10,000 such records. Another feature of the clock 10 of the present invention is that instead of deleting these records or rendering them inaccessible once they have been retrieved, the records can be retrieved multiple times. This solves the problem of losing the records either in the hand-held device, or when connecting the hand-held device to the computer. With prior devices, extracting the records again from the clock was extremely difficult and could not be done by the clock owner, if at all.

With reference again to FIG. 5, although FIG. 2 illustrates the LEDs 122 and the transceiver 128 being disposed on opposite ends of the electronic circuit, in a particularly preferred embodiment, these items are housed within a lens assembly 130 which is disposed between the printed circuit board 114 and the front housing member 100 so as to be aligned with a front window 132 thereof. The window 132 is spaced apart from the touch button contact detector 106, and outside of the raised lip 112 such that when an employee brings a touch button into contact with the detector 106, he or she can still see the lit LEDs 122 through the window 132. Moreover, a user seeking to extract records from the clock 10 will naturally point the hand-held device towards the window 132, where the transceiver is positioned adjacent to the LEDs 122. The clock 10 of the present invention also includes in-circuit programming ports and a serial port so as to connect to other peripherals, such as directly to the computer 116, as described above. As illustrated in FIG. 5, the electronic circuit board includes a multi-pin connector 134 which can be connected to a cable extending between the clock 10 and a peripheral device or computer. It will be appreciated by those skilled in the art that other such connectors to create a physical connection between the clock 10 and another electronic device are contemplated by the present invention. In order to retain the waterproof nature of the clock 10 of the present invention, the connector 134 is disposed within the front and back housings 100 and 102, and only accessible when the back housing 102 is removed. In-circuit programming can be achieved either through the physical connection with the contact 134, or through the infrared wireless transceiver 128. In fact, as discussed above, when time attendance records are retrieved from the clock 10, the hand-held device resets the internal clock 118 via the transceiver 128. This not only avoids drift in the real time clock 118, but also synchronizes the various job clocks 10 used on one or more jobsites. In this manner, as an employee clocks in and out using different clocks at different sites, which can be common in a construction business, the time is synchronized to within seconds so as to record and track an accurate time for the employee.

Figure 6:
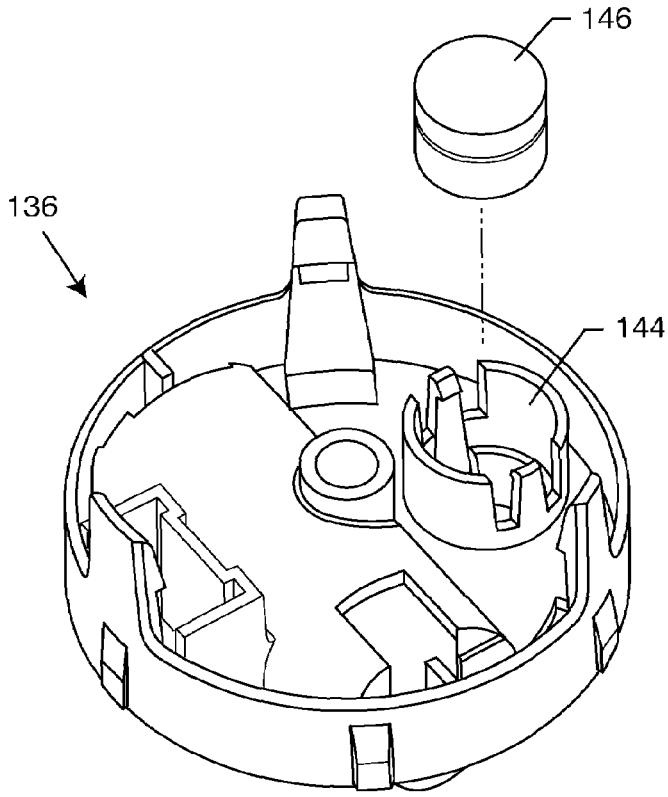
FIG. 6 is a rear perspective view of a battery tray used in accordance with the present invention, illustrating a speaker exploded therefrom.
Figure 7:
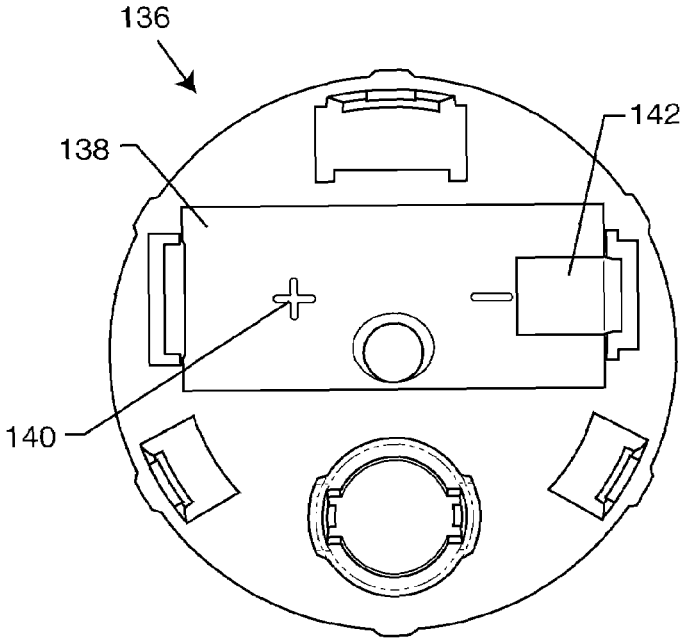
FIG. 7 is a top plan view of the battery tray of FIG. 6, illustrating a front surface thereof, including a battery receptacle.

A battery tray 136 is disposed adjacent to the printed circuit board 114 and configured to hold a battery, typically a CR123 3VDC lithium manganese dioxide battery, which is designed to draw no more than 300 μA so as to last for at least six to nine months. With reference to FIGS. 6 and 7, the battery tray 136 includes a battery receptacle 138 having battery pole symbol markings 140 so as to orient the user as to the position and polarity of the battery insert therein. Moreover, the receptacle 138 includes at least one spring loaded clip 142 for retaining the battery securely therein, even in excessive temperatures which would enable the battery to slip out in previous clocks. The battery tray 136 also includes a receptacle 144 for receiving a transducer or speaker 146 therein. With reference again to FIG. 2, aside from the primary battery 148, the clock 10 includes back-up power in the form of a back-up batter 150, which provides power in the absence of a battery, such as when the primary battery 148 is replaced. The back-up power is provided preferably for at least one hour. This will ensure that the clock 10 remains operational after battery replacement. The clock 10 has the ability to monitor the battery voltage such that a user can be informed when the battery needs to be replaced, such as via the LEDs or audible notification, as indicated above. The clock 10 supports three states of power management, namely, running, idle, or sleep. The clock is in running mode when processing a transaction, such as data from a touch button, a peripheral serial interface, or a wireless transaction through the IRDA signal in hand-held device. The running state requires the most power and is the least common state over time. The clock 10 transitions from a running state to the idle state when the transaction processing is complete. The processor sleeps during the idle state, and all peripherals are placed with the lowest power consumption during this state. In this manner, battery power is conserved. The sleep state only occurs when commanded via peripheral interface, such as the hand-held device or the like. This occurs, for example, when the clock 10 is not to be used for some time, such as when in storage or the like.

With reference again to FIG. 5, a housing guard 152 includes a plurality of prongs 154 configured to be snap fit over recesses or depressions 156 formed in the periphery of the front housing member 100. The housing guard 154 is preferably comprised of a durable plastic material, and is typically of a different color than the front housing member 100, so as to create an aesthetically pleasing appearance, while also distinguishing between different job clocks 10. Thus, for example, one set of workers may utilize the "red" clock, while others utilize the "blue" clock. A bolt 158 extends through the housing guard 152, through the battery tray 136 and into the front housing member 100 so as to sandwich the printed circuit board and sensitive components between the housing guard 152 and the front housing member 100. The clock 10 when fully assembled is waterproof, and resistant to various solvents and liquids. Moreover, the clock 10 is capable of operating in vibrating conditions, high humidity conditions, high temperature or low temperature conditions, or other harsh environments. The clock 10 can survive a drop from up to twelve feet onto a concrete floor on each of the three orthogonal axes. If the housing guard 152 is damaged, it can be replaced.

A plate, typically a metallic plate 160, is attached via bolt 162 to the housing guard 152. The plate 160 includes an extension defining an aperture 164, by which the clock 10 can be hung from an object, such as a pad lock or the like. The plate 164, housing guard 152, and front housing member 100 are typically interconnected with one another. The rear housing member 102 is connected to another plate 166, also having an extension defining an aperture 168, which is generally alignable with the aperture 164 of the other plate 160. A bolt or screw interconnects the plate 166 with the back housing member 102. The gasket 104 typically rests within a recess 172 of the back housing member 102, which also includes threads for being threadedly connected to the front housing member 100. A bolt 174 extends through the back housing member 102 and into the front housing member 100, or the front housing member guard 152, so as to interconnect the plate 166 and back housing member 102 to completely assemble the clock 10.

The back housing member 102 includes plurality of apertures 176 generally aligned with the speaker 124. This enables the speaker sound to be clearly emitted through the clock 10. The speaker apertures 176 are covered with a membrane 178 which allows air to pass therethrough, but is resistant to water. The preferable membrane material is comprised of Gortex material. Typically, an outer label 180 is adhered over the membrane 178 and onto the rear face of the back housing member 102, to securely hold the membrane 178 in place, and also provide identification markings, instructions the like. With reference now to FIG. 4, instead of being flat, the rear housing 102 includes projections 182, or is otherwise irregular in surface such that the sounds from the speaker 124 can be clearly heard even when the clock 10 is placed against a flat surface, such as a wall or the like.

The internal components of the clock 10 can be easily accessed, such as when replacing the battery 148 or accessing the physical electrical contacts 134, by merely removing bolt 174, and unscrewing the back plate 166 and housing 102 assembly from the front housing assembly, containing the remaining components from the front housing member 100 through the front plate 160. This will expose the battery within the battery receptacle 138, and the multi-pronged serial cord connector. This can be done in a matter of seconds without skilled labor. This can also be done, for example, if the clock 10 is dropped and the housing guard 152 is damaged and needs to be replaced. This is easily done by removing bolt 158, and removing the snap-fit connection between the housing guard 152 and front housing member 100, and replacing it with a new housing guard 152.

Although several embodiments have been described in detail for purposes of illustration, various modifications may be made without departing from the scope and spirit of the invention. Accordingly, the invention is not to be limited, except as by the appended claims.

What is claimed is:

1. A time attendance system, comprising:

a portable touch button including a passively readable code;

a time attendance clock, comprising:

a housing sealed against water intrusion, the housing including a front housing member and a back housing member and a gasket disposed between the front and back housing members to provide a water tight seal therebetween;

a housing guard having a plurality of prongs adapted to be snap-fit over the front housing member;

a first plate attached to the back housing member, and a second plate attached to the front housing member, the first and second plates having alignable apertures for hanging the time attendance clock from an object;

a touch button contact extending through, in electrically insulated relation, the front housing member;

an electronic circuit disposed within the housing and electrically connected to the touch button contact so as to receive signals therefrom as the touch button interfaces with the touch button contact, the electronic circuit including a real time clock, a processor and memory and adapted to store a time attendance record comprising a touch button code received from the touch button contact and a time of touch button interface;

a plurality of visual indicators operably connected to the electronic circuit, the plurality of visual indicators being spaced from the touch button contact so as to be viewable through the front housing member as the touch button is moved into proximity to the touch button contact, wherein the plurality of visual indicators comprise different colored light emitting diodes disposed in a lens assembly abutting a window formed in the front housing member, wherein a first light emitting diode emits a green light to visually notify that the touch button has been properly interfaced with the touch button contact, and wherein a second light emitting diode emits a red light to visually indicate that the touch button has been improperly interfaced with the touch button contact;

a transceiver disposed adjacent to the visual indicators and adapted to receive and transmit IrDA signals;

a multi-tone speaker operably connected to the electronic circuit and adapted to emit an audible notification upon occurrence of predetermined events, including an audible notification that the touch button has been properly interfaced with the touch button contact, and another audible notification that the touch button was not properly interfaced with the touch button contact;

means for communicating with the time attendance clock for retrieving stored time attendance records therefrom, wherein the communicating means comprises a hand held electronic device having an infrared signal protocol to communicate with the transceiver of the time clock so as to extract time attendance records;

wherein the back housing member includes a plurality of apertures generally aligned with the speaker to facilitate the transmission of the audible notification from the speaker, and an air permeable, but liquid impermeable, membrane disposed over the apertures of the back housing member to prevent water from entering the housing therethrough; and wherein the back housing member includes projections on a rear face thereof to permit the audible notification to be heard when the time clock is placed against a flat surface.

* * * * *